US005097275A

United States Patent [19]

Takita

[11] Patent Number: 5,097,275

[45] Date of Patent: Mar. 17, 1992

[54] INK JET PRINTER HEAD

[75] Inventor: Masaaki Takita, Osaka, Japan

[73] Assignee: Silk Research & Development Co., Ltd., Osaka, Japan

[21] Appl. No.: 654,734

[22] Filed: Feb. 12, 1991

[30] Foreign Application Priority Data

Feb. 19, 1990 [JP] Japan ..... 2-39350

[51] Int. Cl.[5] ..... B41J 2/05; B41J 2/18

[52] U.S. Cl. ..... 346/140 R

[58] Field of Search ..... 346/140

[56] References Cited

U.S. PATENT DOCUMENTS 4,480,259 10/1984 Kruger ..... 346/140

4,546,360 10/1985 Fischbeck ..... 346/140 X 4,568,953 2/1986 Aoki ..... 346/140

4,723,136 2/1988 Suzumura ..... 346/140

*Primary Examiner*—Joseph W. Hartary

*Attorney, Agent, or Firm*—Trexler, Bushnell, Giangiorgi & Blackstone, Ltd.

[57] ABSTRACT

An ink jet printer head which prints by jetting out ink from a nozzle by means of a heating element. The printer head has two ink chambers above the heating element, with a partition plate separating the two ink chambers. There are at least two holes in the partition plate and allow ink to pass therethrough. At least one of the two holes and the nozzle are provided substantially coaxially with the center of the heating element.

1 Claim, 2 Drawing Sheets

INK JET PRINTER HEAD

The present invention relates to a printing head of an ink jet printer used in office automation (OA) equipment, etc.

As a means of recording graphics, characters, etc. clearly on paper, a printer employing an ink jet head which jets ink from a very small nozzle at a high speed in accordance with an electric signal is used. There are two ink jetting methods now available. One of them jets ink by means of a heating element and the other jets ink by means of a piezoelectric vibrating plate.

Figure 3:
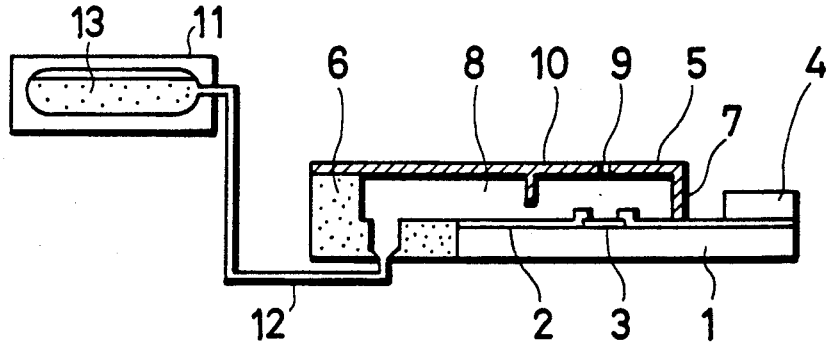
FIG.3 PRIOR ART
Figure 4A:
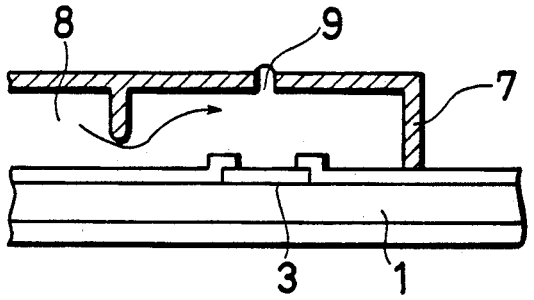
FIG.4(a) PRIOR ART
Figure 4B:
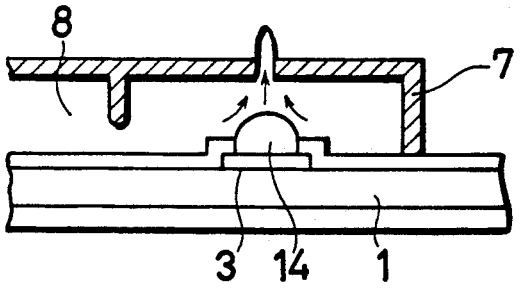
FIG.4(b) PRIOR ART
Figure 4C:
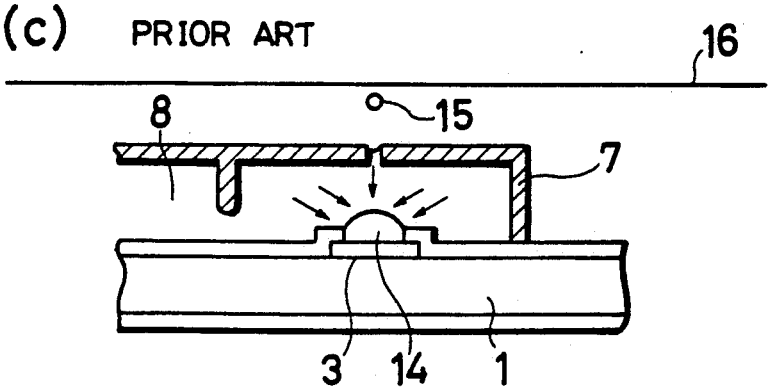
FIG.4(c) PRIOR ART

FIGS. 3 and 4 show a principle of an ink jetting method which uses a heating element. In this method, a conductor 2, a heating element 3 and a drive circuit 4 are provided on a substrate 1 made of ceramics or the like, and an ink chamber 8 enclosed by a flat plate 5, resin material 6 and sealing material 7 is formed.

The flat plate 5 is provided with a nozzle 9, and a projection 10 to form an orifice for easy jetting of ink from the nozzle 9 by bubbles is also provided halfway in the ink passage to the nozzle 9. Numeral 11 is an ink tank, which is connected to the ink chamber 8 by means of an ink feed pipe 12 so that ink 13 of the ink tank 11 provided at an upper position is filled in the ink chamber.

FIG. 4(*a*) through (*c*) are partially enlarged views of FIG. 3, showing how ink particles are generated by the heating element 3. FIG. 4(*a*) illustrates how ink is filled into the ink chamber 8 from the ink tank 11.

When an electric signal is sent to the drive circuit 4 and the heating element 3 is thereby heated, a bubble 14 expands on the heating element 3, as shown in FIG. 4(*b*) and the pressure caused by this bubble is blocked by a projection 10 of a flat plate 5 and is directed to the edge of the nozzle 9. Ink is thereby protruded from the nozzle 9, and are jetting out in the form of an ink particle 15, onto recording paper 16, thus forming a dot thereupon.

If the drive circuit 4 is blocked the moment the ink particle 15 jets out, the heating element 3 is quickly cooled by the ink, and the bubble is shrunk, thereby causing ink to flow into the ink chamber 8 from the ink tank 11. Repeating the processes illustrated in FIGS. 4(*a*), (*b*) and (*c*) allows characters, graphics, etc. to be drawn on the recording paper 16.

This method has a shortcoming in that since ink is jetted out by means of bumping, pressure inside the ink chamber becomes uneven in the process illustrated in FIG. 4(*b*), thereby causing unnecessary fine ink particles to be scattered, and making it difficult to form a beautifully round print dot. Furthermore, there is also another shortcoming in that containment of residual bubbles inside the ink chamber makes the pressure in the ink chamber unstable.

The object of the present invention is to provide an ink jet printer head which draw characters and graphics in high accuracy.

The present invention is an ink jet printer head which prints by jetting out ink from a nozzle, comprising a heating element, a first ink chamber on the heating element, a second ink chamber with the nozzle on the first ink chamber, a partition plate which separates the first and the second ink chambers, and at least two holes in the partition plate which allow ink to pass therethrough, at least one of the two holes and the nozzle being provided substantially coaxially with the center of the heating element.

While this construction can be used alone independently, a plurality of such printer heads can be used in a single printer head.

According to this invention, by circulating the ink in the ink chambers and remove residual bubbles, the bad effect of such bubbles on the ink particles can be lessened. Furthermore, circulating the ink allows the ink to be slow in caking and makes its quality uniform. Furthermore, by making the discharge pressure uniform, uniform ink particles can be stably obtained. Ink particles from an ink jet head according to the present invention are very fine, normally, several ten thousands of dots per second, and smaller than residual bubbles present in the ink chambers.

Figure 1:
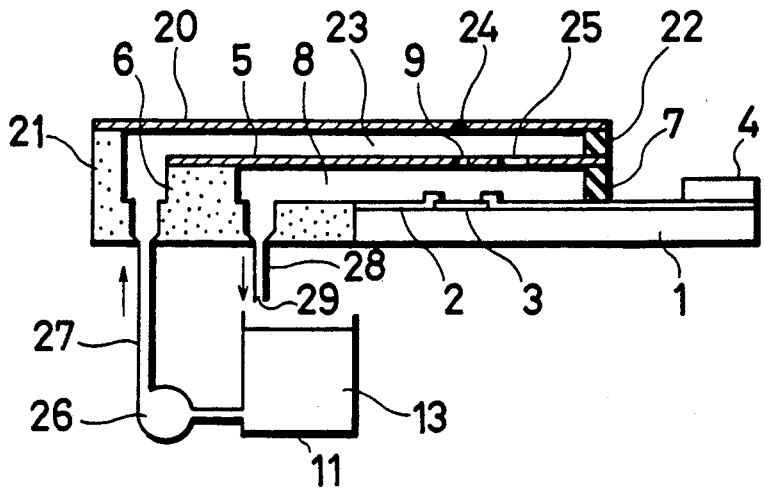
Figure 2A:
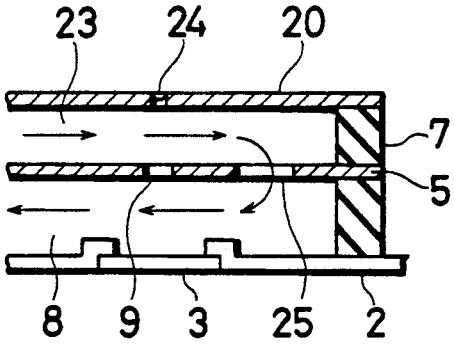
Figure 2B:
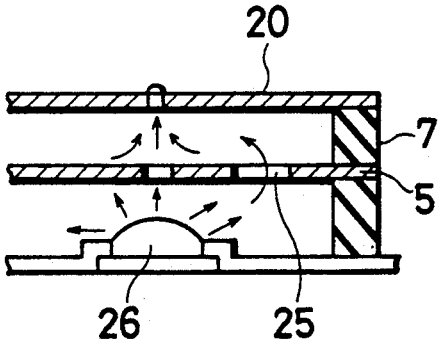
Figure 2C:
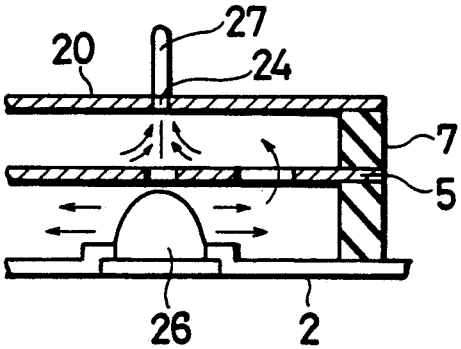
Figure 2D:
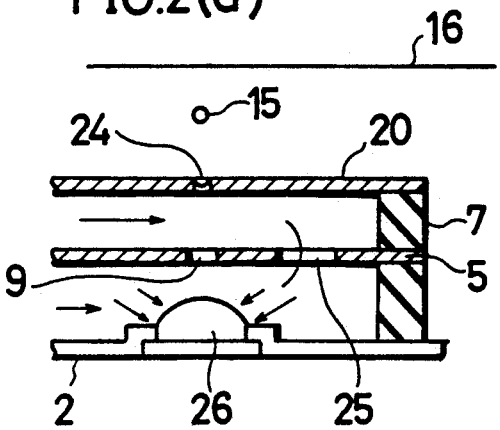

A preferred embodiment of an ink jet printer head according to the present invention will now be described with reference to the accompanying drawings, in which:

FIG. 1 illustrates the principle of the present invention, and

FIGS. 2(*a*) through (*d*) are partially enlarged views of FIG. 1, illustrating the generating processes of ink particles.

In order to make a contrast with the aforementioned prior art shown in FIGS. 3 and 4(*a*) through (*c*), the same parts are given the same numerals, while the elements unique to the present invention are given new numerals starting with 20.

Similarly to the prior art, in the present invention too there are provided a conductor 2, a heating element 3 and a drive circuit 4 on a substrate 1 made of ceramic or the like, and a first ink chamber 8 enclosed by a first flat plate 5, resin 6 and sealing material 7, is formed so that it is in contact with the heating element 3.

In the present invention, a second ink chamber 23 enclosed by a second flat plate 20, resin 21 and sealing material 22 is formed on the first ink chamber 8. Therefore, the first flat plate 5 serves as a partition plate separating the two ink layers chambers 8, 23.

The first and second flat plates 5, 20 are provided with a first hole 9 and a second hole 24, respectively, at the positions which substantially correspond to the center of the heating element 3, with the second hole 24 serving as a nozzle. The first flat plate 5 is provided with a third hole 25 which allows circulation of ink through each ink chambers 8, 23.

Ink 13 inside an ink tank 11 is pressurized by an ink pump 26 and is sent into the first ink chamber 8 through the ink feed pipe 27, the second ink chamber 23 and the second hole 25. It passes through the ink discharge pipe 28, and flows out from the outlet 29 provided at a position lower than the head and then it is stored in the ink tank 11.

FIG. 2(*a*) illustrates an ink flow in a static condition, in which ink in the second hole (nozzle) 24 is normally in the retracted state towards the second ink chamber 23.

FIG. 2(*b*) illustrates the state in which a first bubble 26 is being generated by the heat of the heating element 3. Pressure caused by this bubble 26 is directed towards the first hole 9 of the first flat plate 5, and the second hole (nozzle) 24, as indicated by arrows, jetting out ink by the second hole (nozzle) 24 and at the same time, increasing the jetting power of ink from the second hole 24 of the second flat plate 20 by blocking and reversing the ink flow through the third hole 25 of the first flat plate 5.

FIG. 2(*c*) illustrates the condition in which a first bubble 26 and a second bubble 27 further expand, causing the ink of the second hole (nozzle) 24 to be correspondingly protruded.

FIG. 2(*d*) illustrates the condition in which the ink at the edge of the second hole (nozzle) 24 has jetted out in the form of an ink particle 15, and also shows the ink flow, by arrows, obtained when the first bubble 26 is made smaller due to the blocking of the heating element by the drive circuit 4.

By repeating the processes in FIGS. 2 (*a*) through (*d*), characters and graphics are drawn on the recording paper 16.

While this construction can be used alone independently, a plurality of such printer heads may be installed together.

What is claimed is:

1. An ink jet printer head which prints by jetting out ink from a nozzle, comprising a heating element, a first ink chamber on the heating element, a second ink chamber on the first ink chamber with the nozzle, a partition plate which separates the first and the second ink chambers, and at least two holes in the partition plate which allow ink to pass therethrough, at least one of the two holes and the nozzle being provided substantially coaxially with the center of the heating element.

* * * * *